United States Patent [19]

Tornay

[11] Patent Number: 4,638,754

[45] Date of Patent: Jan. 27, 1987

[54] VESSEL HULL AND BULKHEADS CONSTRUCTION EMPLOYING CURVED PLATING

[76] Inventor: Edmund G. Tornay, 4 E. 95th St., New York, N.Y. 10128

[21] Appl. No.: 716,689

[22] Filed: Mar. 27, 1985

[51] Int. Cl.[4] ..... B63B 3/00

[52] U.S. Cl. ..... 114/79 R

[58] Field of Search ..... 114/79 R, 79 W, 80, 114/56, 65 R

[56] References Cited

U.S. PATENT DOCUMENTS

| | | | |
|---|---|---|---|
| 913,973 | 3/1909 | Petersen | 114/56 |
| 2,330,022 | 9/1943 | Baier | 114/79 R |
| 2,779,303 | 1/1957 | Cupples | 114/79 R |

FOREIGN PATENT DOCUMENTS

| | | | |
|---|---|---|---|
| 21952 | of 1894 | United Kingdom | 114/80 |
| 26036 | of 1910 | United Kingdom | 114/80 |
| 27814 | of 1911 | United Kingdom | 114/80 |
| 20479 | of 1912 | United Kingdom | 114/80 |
| 7792 | of 1913 | United Kingdom | 114/80 |

*Primary Examiner*—Trygve M. Blix
*Assistant Examiner*—Jesûs D. Sotelo
*Attorney, Agent, or Firm*—Kerkam, Stowell, Kondracki & Clarke

[57] ABSTRACT

The hull and bulkheads of vessels are constructed from a plurality of rectangular, in plan, curved steel plates. The plates are rolled to a slight arc of a circle the axis of which is parallel to the longer dimension of the plates. The plates have a mid-plate recurve to which are welded girders with the recurved portion parallel to the long side edges of the plates. The plates on the shell of the ship are arranged with their long edges longitudinal. The long edges of adjacent plates are joined by butt welding as are the shorter edges. Preferably the plates have widths of 4 to 20 feet and radius of curvature of 20 to 100 feet.

6 Claims, 10 Drawing Figures

VESSEL HULL AND BULKHEADS CONSTRUCTION EMPLOYING CURVED PLATING

BACKGROUND OF THE INVENTION

The structure of the hull of a vessel is a complex array of plating and girders which must withstand a variety of external and internal forces while at the same time defining a commercially useful vessel form.

The two general categories of loading which the components of a ship must withstand are longitudinal bending, or the tendency of a hull to bend in a vertical plane due to differences between the longitudinal distributions of weight and buoyancy, and local bending caused by gravity, pressure of the sea and various liquids, fuels, equipment and cargo within the hull. Most structural parts of a ship or vessel are affected by either or both of these load categories.

The traditional element of structure used to construct the surfaces of a vessel is a steel plate stiffened by uniformly spaced parallel structural members. The spacing of these stiffeners is such to permit an acceptable local bending stress in the plate and is determined by the plate thickness and the pressure or load on the plate. The size of the stiffeners themselves depends on their spacing, plate loading and length, or span, between supporting members. These supporting members can be a perpendicular plane of plating or other structural members, larger than the stiffeners, which usually are perpendicular to the primary stiffeners. These deeper secondary members are generally referred to as webs. This type of traditional stiffened flat plate structure is complicated because careful hand construction is required at every intersection of primary and secondary members. Openings must be cut in the secondary webs to allow the primary stiffeners to pass through and clips are welded to both members to assure structural connection. The primary stiffeners are generally run fore and aft and are made continuous through the transverse webs and bulkheads. This is done so that in addition to stiffening the flat plate panels against local loading, they contribute their weight to the weight of the shell plating in providing resistance to the longitudinal bending described above. Generally, for larger vessels longitudinal bending is the predominant source of structural load while for the small vessels, local loading is more important.

In the early 1900's there was an attempt to modify the above referenced form of contruction, particularly in riveted forms of construction and examples of early patents are British Pat. No. 7792, 1913; British Pat. No. 20,479, 1912; British Pat. No. 26,036, 1910; and British Pat. No. 21,952 dated 1894.

BRIEF SUMMARY OF THE INVENTION

In the type of structure of this invention, the plating of the outer hull and bulkheads is constructed of standard sized steel plates, usually about 8 feet by 40 feet, which are rolled to a slight cylindrical curvature, the axis of which is parallel to the longer edge. On the shell of the vessel, the plates are arranged with their long edges longitudinal. The plates are arranged with the curvature inwards or outwards, depending on the direction of the highest local load. The curved plates are then provided with a reverse bend or recurve along the midline between the long longitudinal edges. The short transverse edges and the long longitudinal edges are butt welded together. To the midline of the plates at the recurve are welded longitudinal steel girders such as L or T-beams which match the recurved portion of the curved plates and are of sufficient depth and section modulus to span the distance between transverse bulkheads or deep webs. The local pressure loading on the plate causes a tensile or compressive stress, depending on the direction of the load, uniformly across the thickness of the curved plate in the same way that a cylindrical pressure vessel is stressed by an internal pressure. Because the plating is not subjected to local panel bending, closely spaced primary stiffeners are not required. In addition to efficiently absorbing local pressure forces such as transverse membrane stresses, the curve and reverse curve also provide stiffness in the longitudinal direction needed to resist compressive buckling caused by longitudinal hull bending stresses. An additional efficiency is obtained from the girders along the midline of the curved plates, and thus contribute to the principal section modulus of the hull needed to resist longitudinal bending.

This system of contruction is suitable for any type of commercial or naval ship, or barge, as it can be adapted to any arrangement of decks and bulkheads within the hull. It is particularly suitable for vessels of double hull construction, such as gas tankers with almost complete double hulls and oil and product tankers with double bottoms.

The principal feature of the invention is the use of large radius curved then recurved plating panels longitudinally supported along the longitudinal midline by longitudinal girders, without the use of closely spaced panel stiffeners. The advantages compared to the traditional vessel structure are:

1. Simplification and resulting reduction in construction labor by the elimination of closely spaced panel stiffeners.
2. More efficient use of material in the shell plating by reduction of local bending stresses.

BRIEF DESCRIPTION OF THE DRAWING

The invention will be more particularly described in reference to the accompanying drawing wherein.

DETAILED DESCRIPTION OF THE INVENTION

Figure 3:
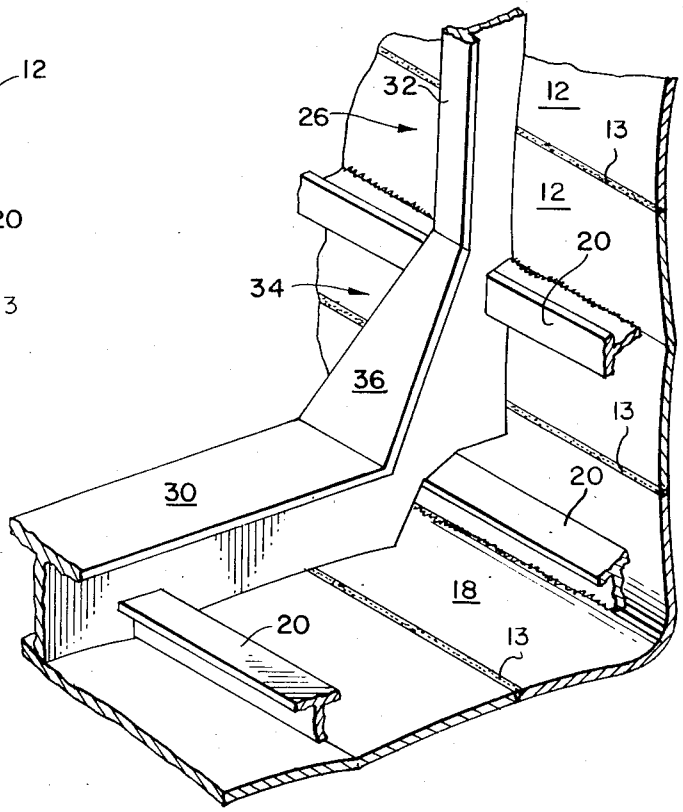
FIG. 3 is a fragmentary perspective view illustrating a portion of the structures shown in FIG. 2.

Referring to the drawing and in particular FIGS. 1, 2, 3, and 10, numeral 10 generally designated a vessel structure of the single bottom form contructed in accordance with the teachings of the present invention.

The plates 12, 14, 16 and 18 of the sides, deck, bulkheads and bottom respectively are formed of large steel plates having slight cylindrical curvature the axis of which is parallel to the longer edge of each plate and recurved along the longitudinal midline. The plates are usually 8 feet by 40 feet however the following plate dimensions and curvature has been calculated to satisfy the principles of the present invention:

plate thickness=¼ in. to 1 in.
plate radius of curvature=20 ft to 100 ft
plate width=4 ft to 20 ft.
plate length=8 ft to 40 ft.

Within these ranges the principles of the present invention are fully obtainable.

Figure 10:
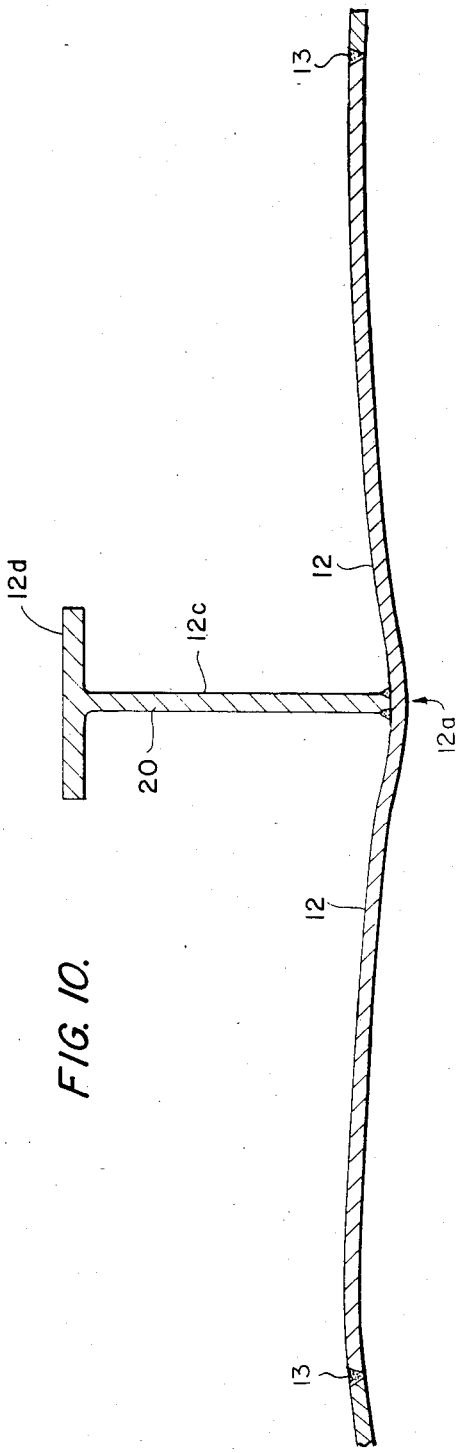
FIG. 10 illustrate the method of forming the curved plates of the ship.

Referring to FIG. 10 one of the curved plates 12 is illustrated together with the plates recurved portion 12*a* which lies midway between the two longitudinal long edges 13. Along the center of the recurved portion 12*a* is welded a longitudinal extending girder 20. The girder 20 in the illustrated form of the invention comprises a T-beam, however other forms of girders maybe used such an angle girder.

In general the recurved portion 12*a* would be formed on a brake thus the radius of curvature of the recurved portion would be small, for example in the order of 12 times the plate thickness.

At spaced intervals throughout the length of the vessel are welded bottom frames 22, top frames 24, side frames 26 and partition frames 28 of angle configuration as illustrated in FIG. 3. These frame members are welded into a generally box configuration and the longitudinal members 20 are welded to the frames 22, 24, 26, and 28 either 100% or partially. It will be particularly noted from FIG. 3 that the top web 30 of bottom frame 22 may be broader than the top flange 32 of the side frame members such as 26 and 28. Thus where they join there is provided a triangular frame bracket generally designated 34 having a top flange 36. Also as illustrated in FIG. 3 the longitudinals 20 may pass through the frame members 24, 26, and 28. For added strength at each frame there may be provided cross braces such as illustrated at 38, 40, and 42 FIG. 1 of the drawing.

It has been found that transverse frames 22, 24, 26, and 28 if spaced at longitudinal intervals of from about 6 feet to about 18 feet provide sufficient strength for normal transport vessels.

As hereinbefore described the curved plates 12, 14, 16 and 18 forming the sidewalls, deck, interior partitions and bottom are buttwelded at transverse joints between plates.

The simplicity of construction should be apparent to those skilled in the art from the foregoing description.

The present invention also lends itself to ship construction having innerbottoms and likewise inner sidewalls. Reference will now be had to FIGS. 4–9 illustrating a ship constructed in accordance with the teachings of the present invention having an innerbottom. In FIGS. 4–9 elements corresponding to elements illustrated in FIGS. 1, 2, 3, and 10 are provided with primed reference characters.

The vessel depicted in the second form of the invention includes a top deck 14', outer side wall 12', inner bulkhead 16', bottom 18' and inner bottom 52. These structures as in the first form of the invention have curved plates constructed as shown in FIG. 10.

The present form of the invention differs from that in the first form in that the ship has a double bottom generally designated 50 comprised of bottom 18' and spaced upwardly therefrom a second bottom 52 which is also formed of curved linear plates. Between the two bottoms 18' and 52 are a plurality of compartments 54 formed by longitudinal plates 56 welded to bottoms 18' and 52 and a plurality of transverse webs generally designated 58. The system also includes a plurality of angle stiffeners more particularly illustrated in FIGS. 6–9. Along the upper edges of each of the longitudinal plates is an angle stiffener 60 and at each of the transverse webs 58 are a plurality of transverse angle stiffeners 62. The angle stiffeners 60 and 62 together with the longitudinals 56 and transverse plates 58 divide the space between the pair of bottoms 18' and 52 into numerous quadrangular compartments best illustrated at 64 in FIG. 6. This form of construction materially strengthens the vessel and in the event of rupture only those compartments 64 actually exposed to the rupture would flood.

In the double bottom form of construction frames 24', 26', and 28' are provided with triangular frame bracket elements 36' as illustrated in FIG. 3 of the description pertaining to the single bottom form of the invention.

It will also be recognized by those skilled in the art that the sidewall 12' of the vessel having the double bottom may also include interior walls formed in a manner like the double bottom described and where double sidewalls are used both the inner or outer walls would be formed of curved plates.

Figure 1:
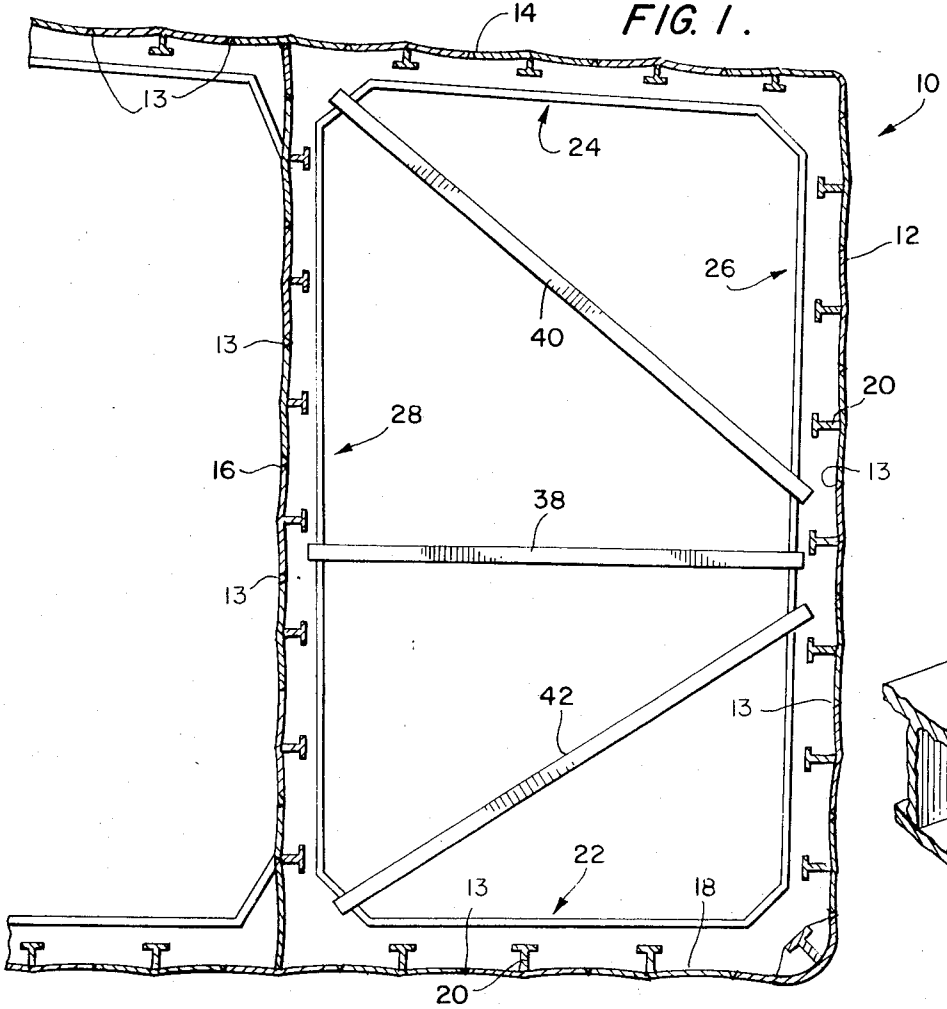
FIG. 1 is a midship section of a ship hull having no innerbottom.
Figure 4:
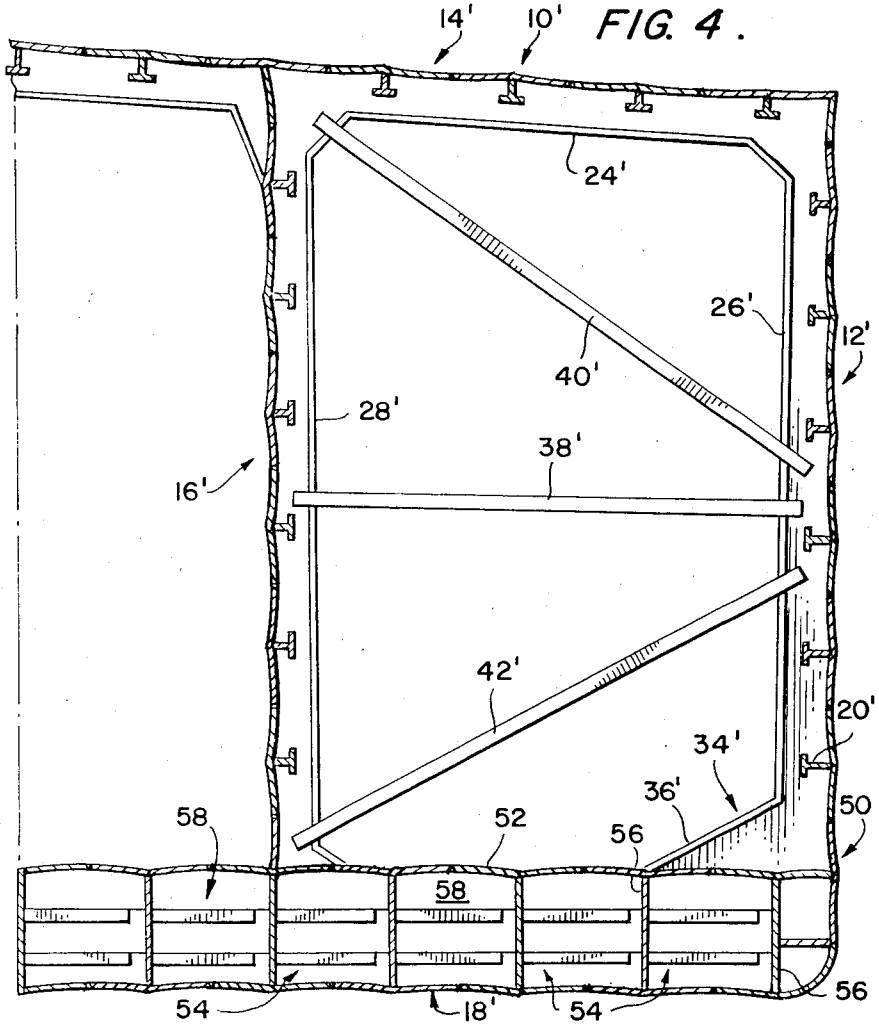
FIG. 4 is a view like FIG. 1 of a ship having an innerbottom.
Figure 2:
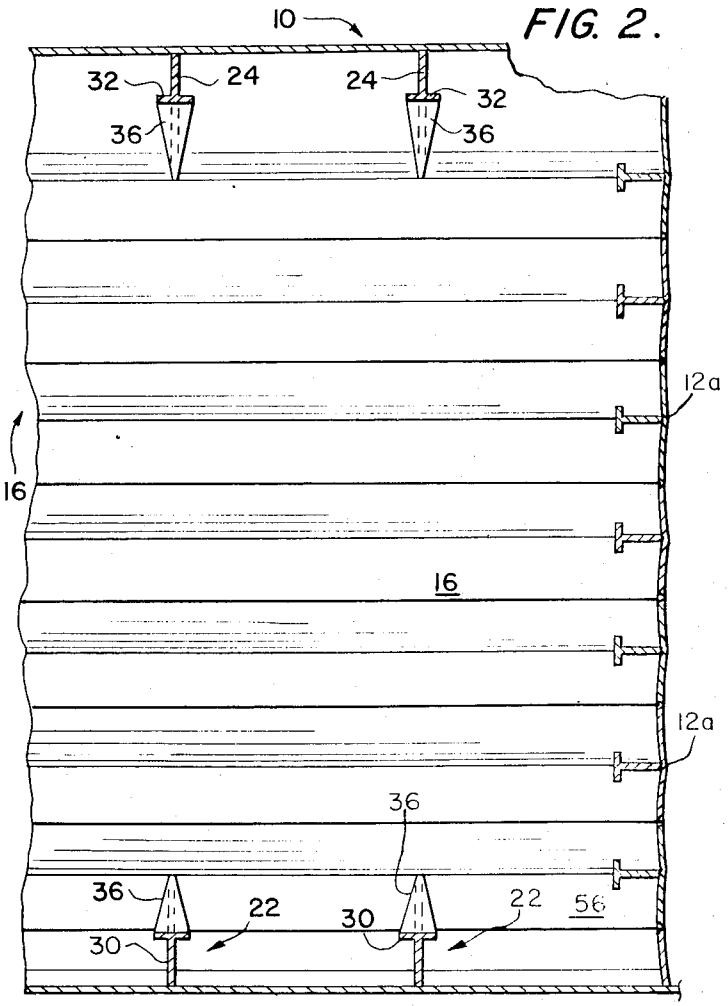
FIG. 2 is a fragmentary sectional view of the structures shown in FIG. 1 looking outboard from the center line of the ship.
Figure 6:
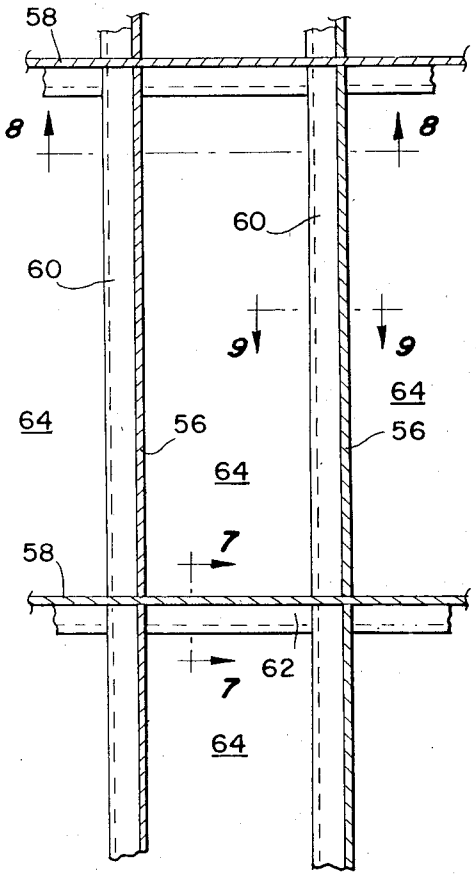
FIG. 6 is a fragmentary plan view of the innerbottom shown in FIGS. 4 and 5.
Figure 5:
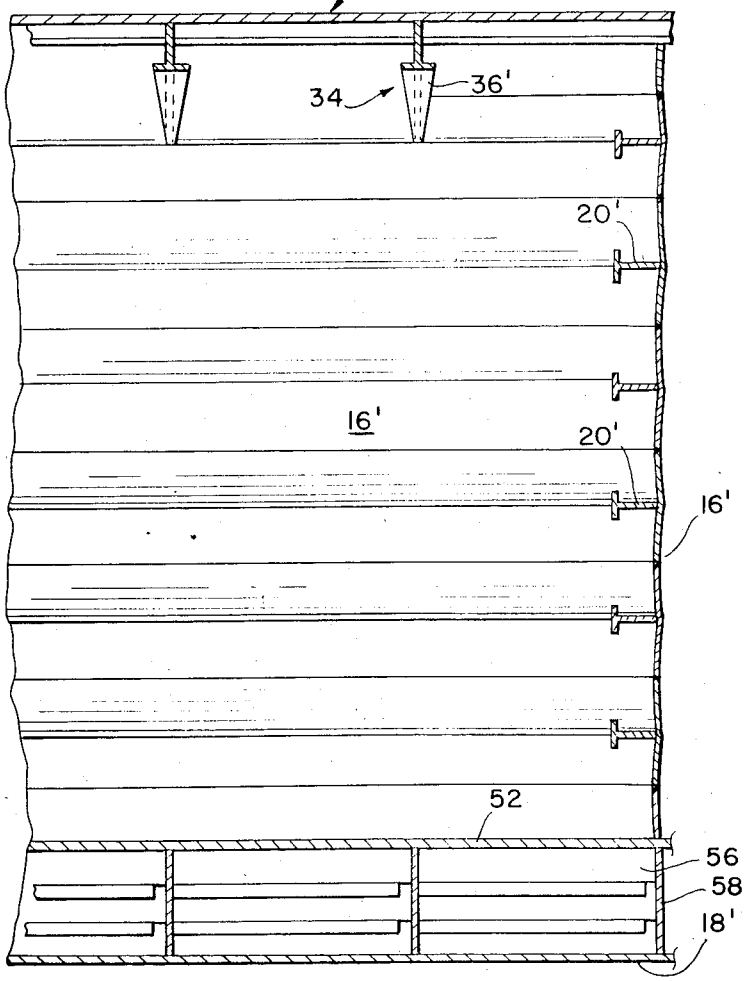
FIG. 5 is a fragmentary sectional view of the structures shown in FIG. 4 looking outboard from the center line of the ship.
Figure 9:
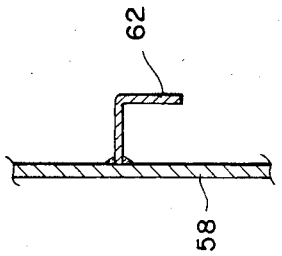
FIG. 9 is a section on line 9—9 of FIG. 6.
Figure 7:
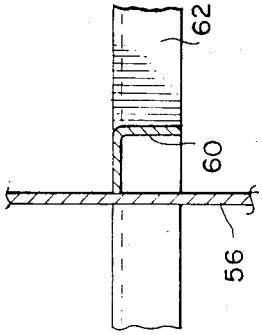
FIG. 7 is a section on line 7—7 of FIG. 6.
Figure 8:
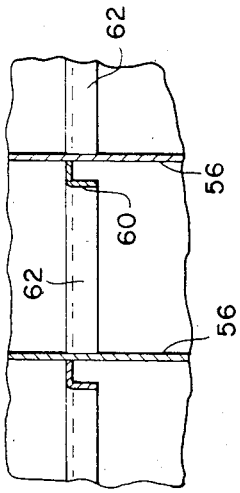
FIG. 8 is a section on line 8—8 of FIG. 6.

As described in reference to FIG. 1 of the drawings the second form of the invention would be provided with rigifying angles 38', 40' and 42' at each of the transverse interior bulkheads.

As hereinbefore set forth basically the novelty of the present invention lies in the combination of girders and curved plates 12. In general on single sidewall, single bottom vessels the girders would be formed from ¼ to 1 inch steel and would have webs 12C, FIG. 10, from about 8 to about 30 inches wide and plate 12*d* from about 4 to about 24 inches wide.

Vessels having double side walls and double bottom the lesser of the dimensions set forth above would be used and the longitudinal and transverse plates would be from about 3/16" to 1" thick.

It will be appreciated by those skilled in the art that various modifications will be made in the form of vessel construction as long as the exposed walls and bottoms and preferable the inner walls have curved linear plates which are welded along their long axis and having girders welded along mid positioned recurved portions thereby providing simplified vessel construction which in addition effectively absorbs local pressure forces as transverse membrane stresses and provide stiffness in the longitudinal direction needed to resist compressive buckling caused by longitudinal hull bending stresses.

I claim:

1. A vessel comprising sides, bottom and at least one deck, said sides, bottom and at least one deck formed of welded together rectangular steel plates, said plates being formed to a slight cylindrical curvature the axis of which is parallel to the longer of the edges of the plates, said plates having a recurved cusp portion midway between the long edges and parallel thereto, and girders welded along the recurved cusp portions parallel to the longer edges of the plates.

2. A vessel as defined in claim 1 wherein the girders have heights of from about 8 to about 30 inches.

3. The vessel as defined in claim 2 wherein the girders are T-shaped beams and the top plate of the T-shaped beams is from 4 to about 24 inches in width.

4. The vessel as defined in claim 2 wherein an innerbottom is provided for the vessel and the innerbottom is constructed by plates formed to a slight cylindrical curvature the axis of which is parallel to the longer of the edges of the plates.

5. The vessel as defined in claim 2 wherein the plates are butt welded to adjacent plates and the radius of curvature of the plates is from 20 to about 100 feet.

6. The invention defined in claim 5 wherein the plates have widths from 4 to about 20 feet and the length of the plates is from about 8 to about 40 feet.

* * * * *